United States Patent [19]

Day

[11] 3,984,646

[45] Oct. 5, 1976

[54] LIMIT SWITCH ACTUATOR

[76] Inventor: Harry E. Day, 1612 Apple Lane, Bloomfield Hills, Mich. 48013

[22] Filed: Apr. 29, 1975

[21] Appl. No.: 572,899

[52] U.S. Cl. ..... 200/47; 200/153 L

[51] Int. Cl.[2] ..... H01H 3/16

[58] Field of Search..... 200/47, 153 L, 153 LA, 200/153 LB; 74/107

[56] References Cited

UNITED STATES PATENTS 3,433,907 3/1969 Day..... 200/47

*Primary Examiner*—Robert K. Schaefer
*Assistant Examiner*—Morris Ginsburg
*Attorney, Agent, or Firm*—Harness, Dickey & Pierce

[57] ABSTRACT

An assembly for mounting limit switches directly on the cylinder of a fluid-actuated motor or similar linearly reciprocable actuator. An extruded housing of V-shaped cross-section has exterior slots for alternate mounting on fittings extending from the cylinder ports and interior slots for supporting limit switches in a variety of positions. A reciprocable rod carrying a switch actuating cam is slidably mounted in the housing and connected to the piston rod or other actuator by a novel yoke-and-connector arrangement which, by virtue of the free rotary movement allowed the rod and the annular shape of the cam, prevents misalignment between the cam and switches during assembly or maintenance of the parts. The unit furnishes maximum freedom of choice in positioning the switches, and is adaptable for various cylinder diameters.

24 Claims, 6 Drawing Figures

LIMIT SWITCH ACTUATOR

BACKGROUND OF THE INVENTION

Field of the Invention

The invention relates to actuators, and more particularly to means for mounting limit switches and their actuators in a position to be directly controlled by reciprocable members such as the piston rods of fluid-actuated motors.

Description of the Prior Art

My U.S. Pat. No. 3,433,907 issued Mar. 18, 1969, discloses means for mounting limit switches and actuators on a fluid-actuated reciprocable motor and includes among its features the adjustability of the cams and limit switches in a variety of positions. However, this prior art device has several drawbacks which it is an object of the present invention to overcome. Among the areas of improvement of my present invention over the patented construction are the enclosed nature of the unit, increased mounting and positioning flexibility, and reduced danger of misalignment between the cam and switches when the parts are assembled.

A search on the subject matter of this invention revealed the follwing patents:

Weishew U.S. Pat. No. 2,914,626
Horberg U.S. Pat. No. 3,176,088
Horberg U.S. Pat. No. 3,192,349
Horbert U.S. Pat. No. 3,192,350
Ziegler U.S. Pat. No. 3,472,977

These patents fail to disclose the invention or its advantages because, among other reasons, they are not mountable in the same manner directly on a cylinder, they fail to teach the mounting and adjustment flexibility between the cam and switches, and they have no disclosure of the connecting means between the piston rod and cam supporting rod which has the advantages described below.

BRIEF SUMMARY OF THE INVENTION

It is an object of the present invention to provide a novel and improved limit switch actuator which is easily and securely mountable directly on a cylinder in a variety of positions, and fully encloses the limit switches so as to prevent interference with their action by dust, dirt or grease.

It is another object to provide a novel and improved limit switch actuator of this nature having a housing construction which is simply and quickly formed to be compatible with any cylinder length and stroke.

It is a further object to provide an improved limit switch actuator in which various types, sizes and positions of limit switches can be used and in which the circumferential positions of the limit switches with respect to the cam actuator is immaterial.

It is also an object to provide an improved switch actuator of this character which simplifies the bearing means for guiding the cam actuating rod by incorporating this guide means as part of the housing when formed.

It is another object to provide an improved switch actuator of this character which permits a simplified connection between the piston rod and cam actuating rod in a manner minimizing the possibility of misalignment or maladjustment between the cam and limit switches when the parts are assembled.

Briefly, the illustrated embodiment of the invention comprises an elongated housing of V-shaped cross-section having a plurality of slots on its external surface, a pair of clamps mountable in either of said slots and engageable with external fittings on the cylinder of a fluid-actuated motor, a plurality of slots on the interior of said V-shaped housing, means supporting limit switches in any of said interior slots, end plates and a cover for the open side of said housing, a cam actuating rod slidably mounted in said housing, a cam fixed to the end of said rod within said housing and engageable with said limit switches, and a connection between the other end of said rod and the piston rod of said motor.

In another aspect, the invention comprises a limit switch housing, means for mounting limit switches within said housing, means on the exterior of said housing for securing it directly to the cylinder of a reciprocable motor, a cam actuating rod slidable within said housing, a cam on said rod engageable with said limit switches, and connecting means between the piston rod of said motor and one end of said cam actuating rod comprising a pair of plates on said piston, a yoke having one end disposed between said plates, a connector having a portion secured to the other end of said yoke, a split bushing surrounding the end of said cam actuating rod, and portions on said connector which clamp said split bushing on the cam actuating rod.

DESCRIPTION OF THE PREFERRED EMBODIMENT

The limit switch actuator is generally indicated at 11 and is adapted for use with a reciprocable fluid motor generally indicated at 12 having a double acting cylinder 13 and a piston rod 14 extending from one end thereof. The piston rod is connected by a conventional clevis 15 to an actuated member (not shown), the movement of which is to be coordinated with the actuation of limit switches. Two such switches are indicated at 16 and 17 by way of example.

Figure 5:
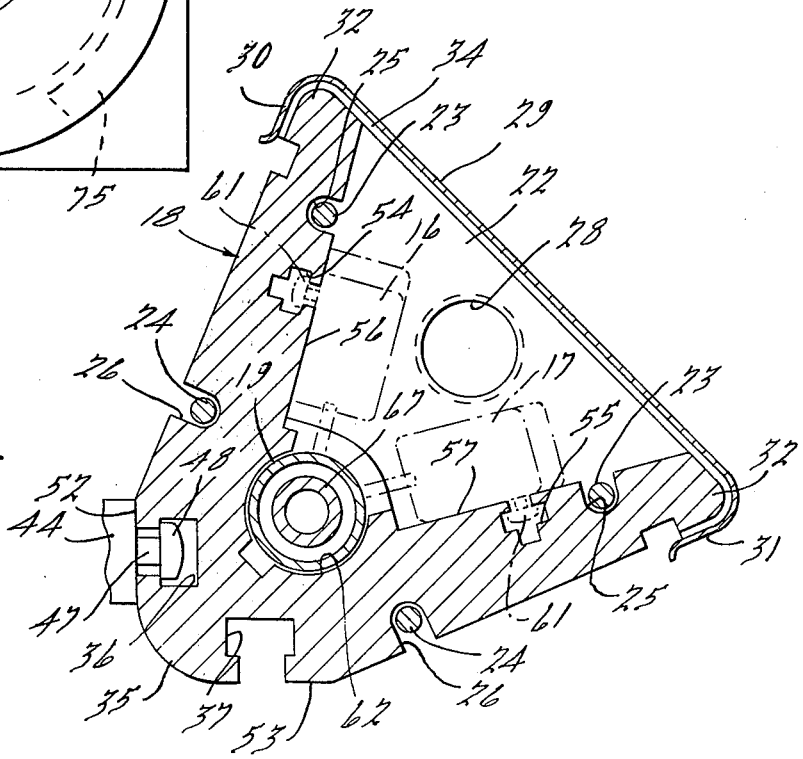
FIG. 5 is a cross-sectional view taken along the line 5—5 of FIG. 4 and showing alternate positioning of the switch housings as well as the guide means for the cam actuating rod.

The limit switch actuator comprises a housing generally indicated at 18 within which limit switches 16 and 17 are mounted and which supports and guides a hollow cam actuating rod 19 carrying a cam generally indicated at 20 at one end thereof within the housing. Housing 18 is of elongated shape with a constant cross-section which is generally V-shaped as is shown in FIG. 5. Suitably, the housing may be fabricated by an extrusion process, so that for quantity production purposes, the length of the housing may be chosen appropriately to that of motor 12 or its stroke simply by cutting off the proper length of extruded stock. A pair of end plates 21 and 22 are mounted at the opposite ends of housing 18, being held in position within recesses at the housing ends by tie rod bolts 23 and 24. These bolts are disposed in recesses 25 and 26 respectively formed on the interior and exterior of the V-shaped housing. Wiring apertures 27 and 28 are formed in end plates 21 and 22 respectively.

A cover 29 is provided for the open portion of housing 18, this cover being suitably fabricated of a spring-like metal or similar resilient material. The cover has a pair of inwardly curved flanges 30 and 31 adapted to snap over a pair of housing lips 32. If desired, gasket material 33 may be provided between cover 29 and the outer surface 34 of housing 18 to prevent moisture or contaminants from entering.

The rounded apex portion 35 of the outer housing surface is provided with a pair of suitably shouldered longitudinal slots 36 and 37 for mounting the unit on cylinder 13. Preferably, these slots are open in directions transverse to each other, and either slot may be used for the mounting, thereby providing flexibility of orientation without the need for additional machining. For mounting purposes, a pair of fittings 38 and 39 are screwed into the conventional ports of the cylinder, the fittings having cylindrical surfaces 41 extending therefrom. A sleeve 42 suitably formed of a plastic material is slipped onto each surface 41, the sleeves being of split annular shape with an extended portion 43 on one side. A metal strap type of bracket 44 surrounds each sleeve 42 and has extensions 45 and 46 from portion 43 of the sleeve. A bolt 47 extends through apertures in portions 45 and 46 of the bracket and with a head 48 of the bolt being disposed in either T-slot 36 or 37. Extension 46 of each bracket 44 has an end portion 49 disposed within the slot to maintain alignment of the bracket. A nut 51 on each bolt 47, when tightened, will secure the housing in place, drawing the appropriate flat surface 52 or 53 of the housing (FIG. 5) against leg 46 of bracket 44 with the bracket being tightly secured to its fitting 38 or 39 through sleeve 42. The mounting flexibility afforded by the two slots 36 and 37 will permit the housing to be mounted in various locations where clearance may be limited.

Figures 2, 4:
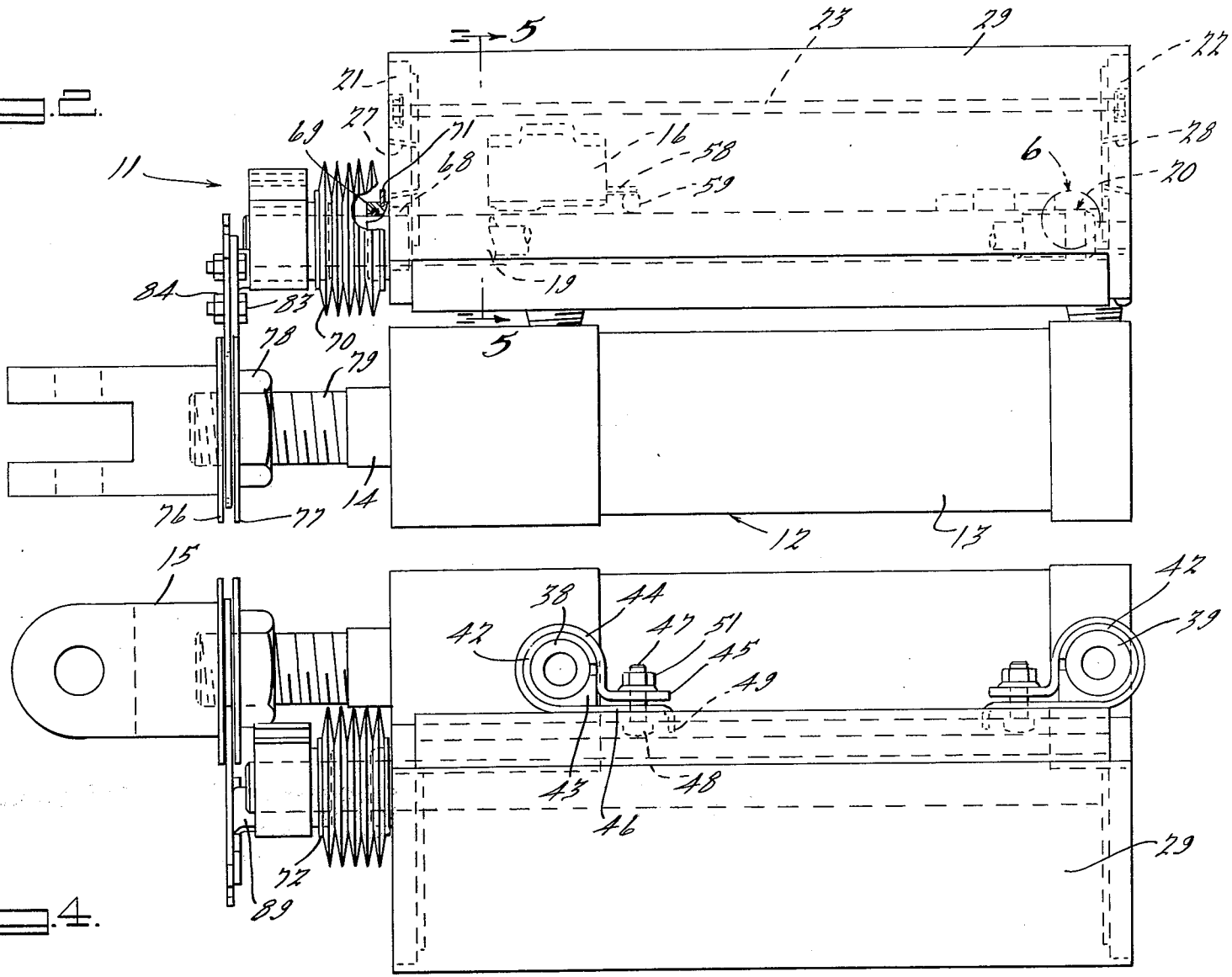
FIG. 2 is a side elevational view of the switch actuator, parts being sectioned.
FIG. 4 is a top plan view showing the manner in which the housing is secured to cylinder port adapters.
Figure 3:
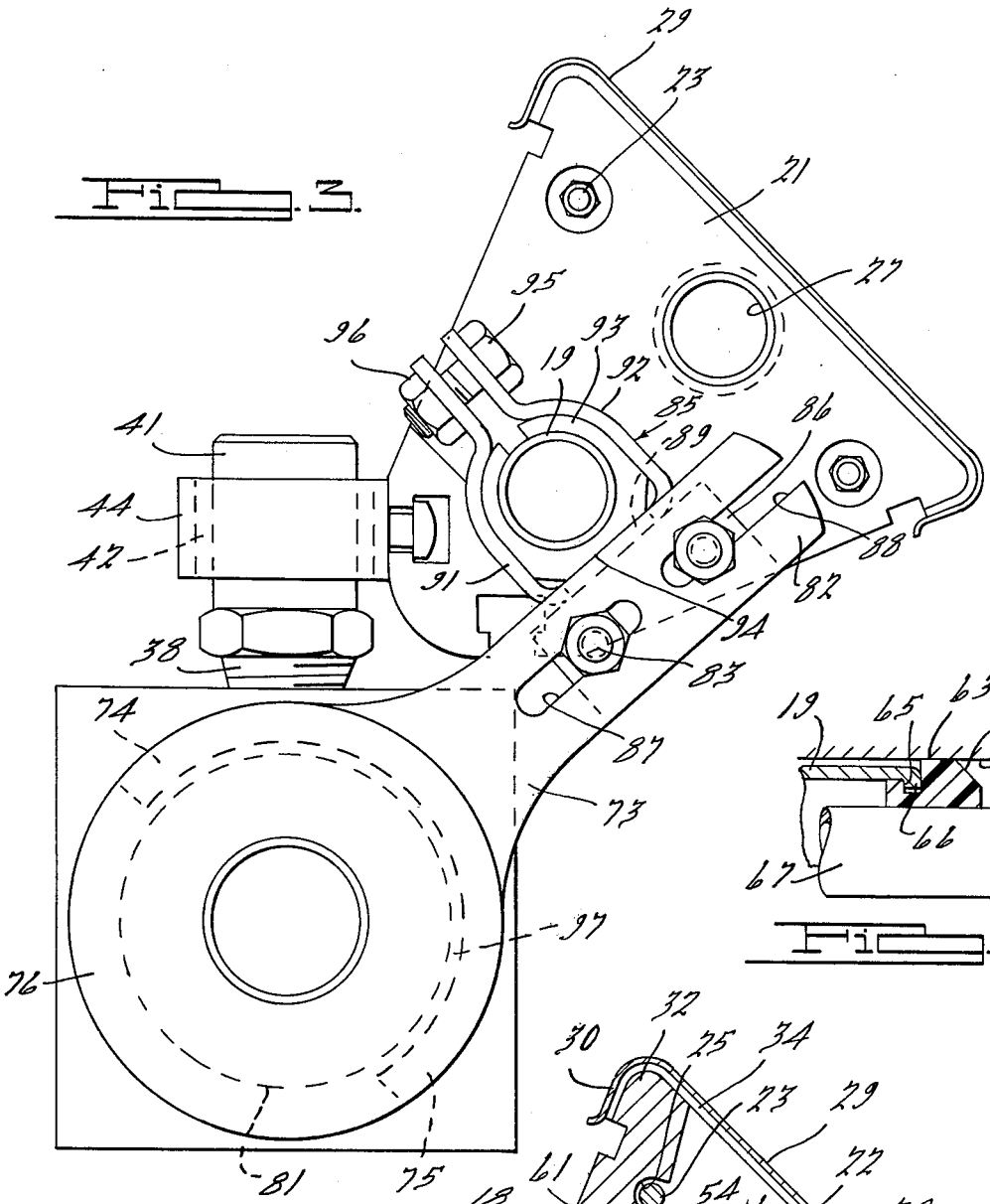
FIG. 3 is an end elevational view taken in the direction of the arrow 3 of FIG. 2, the clevis being omitted.

A pair of shouldered longitudinal slots 54 and 55 are formed on the interior surfaces 56 and 57 respectively of housing 18 which face the housing interior. These are for the purpose of mounting the limit switches. As in the case of slots 36 and 37, the limit switch mounting slots permit flexibility in longitudinal adjustment of the limit switches without further machining being necessary, and the switches may be mounted on either or both interior walls. Furthermore, the switches may be of various dimensions so that their arms 58 (FIG. 2) with their cam followers 59 may be in any desired circumferential location within the housing. Headed bolts 61 are used to mount the switches in their slots. The switches may be of the normally open or normally closed type, or in some case combined normally opened or normally closed switches could be used.

Figure 6:
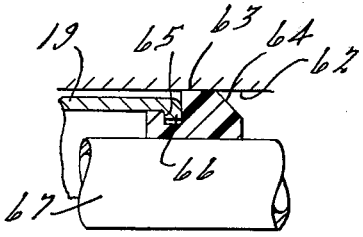
FIG. 6 is an enlarged detail view in the area of circle 6 of FIG. 2 showing the cam construction.

An arcuate cam guide surface 62 is formed at the central portion or apex of housing 18, this surface being formed as part of the extrusion process and being open toward the housing compartment. Rod 19 has an external diameter which is slightly smaller than that of surface 62, thus preventing interference due to possible warping of the parts, but cam 20 is guided by this surface. The cam, which may suitably be fabricated of a plastic material, is of annular shape and has a cylindrical surface portion 63 engageable with guide surface 62, and an inclined actuating shoulder 64 at its outer end, this shoulder being engageable with cam followers 59. Cam 20 is secured to the end of rod 19 within housing 18, for example by a groove 65 (FIG. 6) formed in the cam and receiving a rolled-in portion 66 of rod 19. In some cases, it may be desirable to provide an inner support rod 67 for assisting in the guidance of cam 20. This rod, which is stationary, extends through hollow cam actuating rod 19 and is secured at its opposite ends to end plates 21 and 22. Cam 20 is slidably supported by rod 67.

A bearing 68 is mounted in end plate 21 through which rod 19 extends. A scraper 69 may be mounted in a recessed portion of bearing 68 for engagement with rod 19, to prevent foreign matter from entering the housing or scoring the bearing surfaces.

It should be observed that the annular shape of cam 20 and its actuating surface 64 will permit actuation of the limit switches regardless of the circumferential positions of their cam followers 59 within housing 18. Furthermore, rod 19 and cam 20 are mounted in a manner permitting unrestrained movement of the rod and cam about their common axis, so as to accommodate various mounting positions of the housing with respect to piston rod 14, and cam 20 will be effective to actuate the limit switches regardless of its rotated position and that of its actuating rod.

To further prevent the possibility of foreign matter or contaminants from entering the housing interior, an expandable boot 70 is mounted on the external portion of rod 19. One end of this boot may be secured to a member 71 in a groove machined in the outer surface of that portion of bearing 68 outside end plate 21, the other end of the boot being secured to a member 72 fixed to rod 19.

The means for connecting piston rod 14 to cam actuating rod 19 comprises a yoke 73 having a pair of arms 74 and 75 disposed between holding discs 76 and 77 which are secured between clevis 15 and a nut 78 on a threaded portion 79 of piston rod 14. Holding discs 76 and 77 are held apart by a washer 81. A central arm 82 on the yoke extends from the juncture of arms 74 and 75 and is secured by bolts 83 and nuts 84 to a connector generally indicated at 85. This member may suitably be fabricated by a stamping or casting which is shaped as shown. One portion 86 of member 85 is of rectangular shape and has apertures for bolts 83, the bolts passing through elongated slots 87 and 88 in yoke arm 82 so that the position of connector 85 with respect to the cylinder axis may be preadjusted. A portion 89 on member 85 extends at right angles from portion 86, and a pair of clamping arms 91 and 92 extend laterally from portion 89. These clamping arms extend on both sides of cam actuating rod 19. A split bushing 93, preferably of a resilient plastic material which will allow for float and shock, is disposed between rod 19 and arms 91 and 92. The bushing and arms have complementary surfaces so as to achieve maximum contact, with bushing 93 having a flat surface 94 engageable with portion 89 of connector 85. A bolt 95 and nut 96 are provided for tightening arms 91 and 92 about bushing 93 and rod 19.

Because of this novel connecting arrrangement the assembly may be utilized with various diameters of cylinders, since rod 19 will be rotatably adjustable with respect to connector 85. The relative longitudinal positions of the cam and piston rod are also infinitely adjustable. The circumferential play permitted by the yoke and disc construction in the area of the piston rod permits relative rotation of the piston rod with respect to the other components, and no torque will be transmitted during tightening of the parts which could adversely effect the alignment or positioning of cam 20 and the limit switches. Axial movements will still be transmitted accurately from the piston rod to cam 20. Elimination of the possibility of binding will assure that rod 19 will not be subjected to lateral flexure forces which might interfere with accuracy of movement. To further insure this result, a radial clearance 97 is preferably provided between arms 74 and 75 and washer 81, thus preventing binding due to misalignment or nonparallelism between rod 19 and piston rod 14. Even if the misalignment should exceed this clearance, any rotation of yoke 73 which causes rotation of rod 19 will still not detract from the accuracy of cam actuation, due to the annular nature of cam surface 64. The insulative nature of bushing 93 as well as cylinder mounting sleeves 42 will afford full electrical insulation when required.

Figure 1:
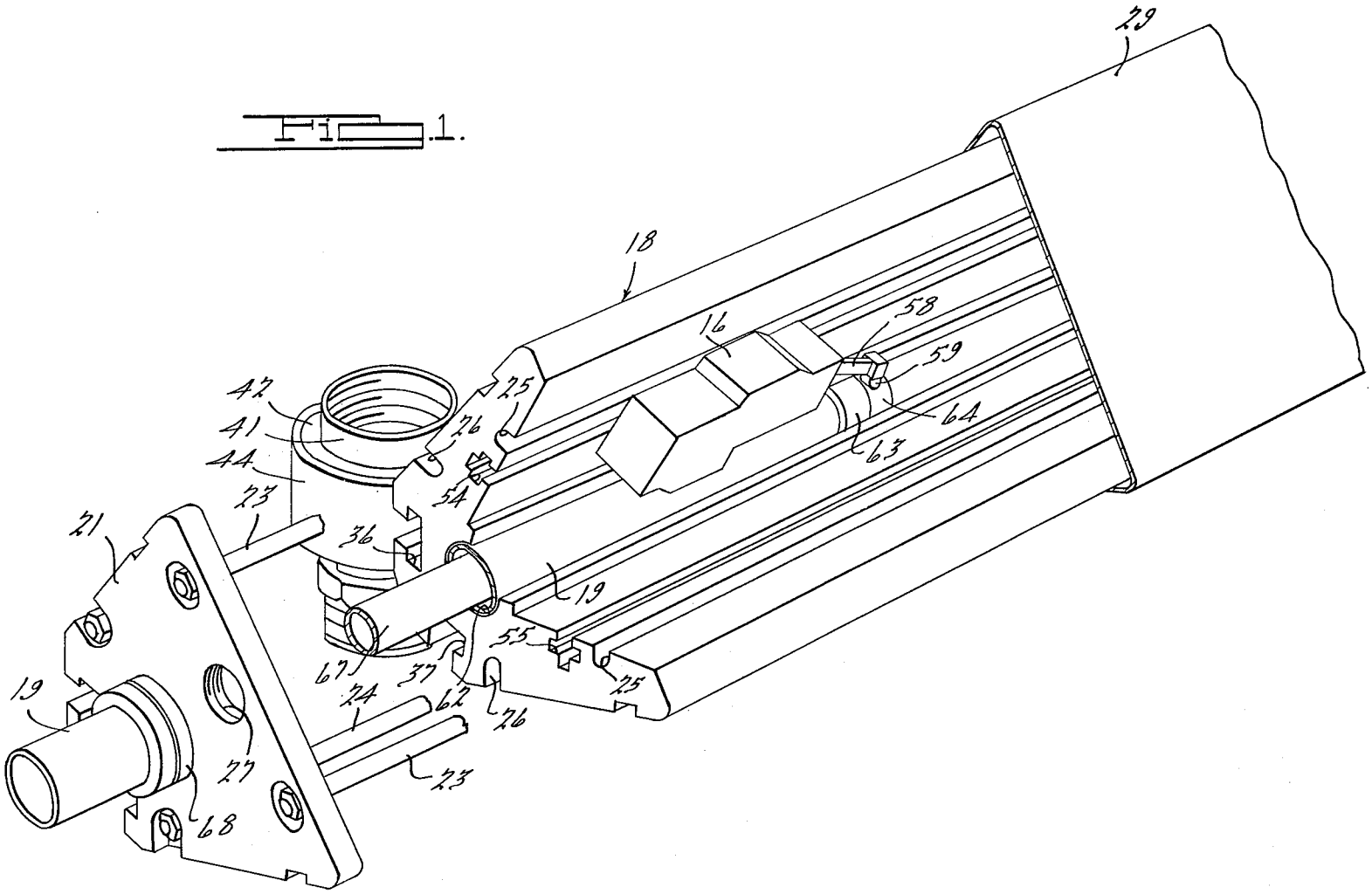
FIG. 1 is an exploded perspective view of a portion of the invention, parts being broken away and omitted.

The operation of the assembled limit switch actuator will be apparent from the above description. Extension of piston rod 14 to the left in FIG. 1 will cause cam actuating rod 19 to similarly move to the left, the forces being transmitted through yoke 73 and connector 85. Cam 20 will slide along guide surface 62 and acutate cam followers 59 as it reaches each follower.

I claim as my invention:

1. In a limit switch actuator for use in conjunction with a reciprocable member, an elongated housing of V-shaped cross-section having at least one slot on its external surface, clamp means adjustably secured along said slot and attached to a stationary support, at least one slot on the interior of said V-shaped housing, end plates on said housing, a removable cover for the open side of said housing, means adjustably securing a limit switch of the type having a cam follower at a preselected position along said interior slot so that the cam follower extends toward the housing apex, a cam actuating rod slidably mounted at the apex of said housing, a cam secured to said rod within said housing, said cam being engageable by said cam follower, said rod extending through one of said end plates outwardly of said housing, and a connection between the outer portion of said rod and said reciprocable member.

2. The combination according to claim 1, said V-shaped housing being formed from an extruded section, said interior and external slots being shouldered and formed as part of said extruded section, and an arcuate guide surface for said cam formed as part of said extruded section at said housing apex.

3. The combination according to claim 2, said housing having a pair of angularly disposed lips along its outer edges, said removable cover having resilient flanges which snap over said lips.

4. The combination according to claim 1, said reciprocable member being the piston rod of a fluid-actuated motor having a pair of cylinder ports, said stationary support comprising the cylinder of said motor, fittings extending from said ports and having cylindrical surfaces, said clamp means comprising a pair of insulative bushings surrounding said cylindrical fitting surfaces, straps surrounding said bushings and having overlapping ends parallel to said external slot, and a bolt engageable in a slot and having a nut for tightening the strap ends.

5. The combination according to claim 4, there being two external slots disposed on opposite sides of the housing apex, said slots facing in transverse directions, whereby the slots are alternately usable to mount the housing so as to adapt to clearances.

6. The combination according to claim 1, said V-shaped housing having two flat internal surfaces facing the housing interior, there being two internal slots on said two surfaces.

7. The combination according to claim 6, there being two external slots formed on opposite sides of the housing apex facing in transverse directions.

8. The combination according to claim 7, all four of said slots being shouldered.

9. The combination according to claim 1, said housing being formed from an extruded section, an arcuate guide surface formed on the housing interior as part of said extruded section, said rod being disposed within said arcuate guide surface with slight clearance, said cam being secured to the end of said rod and slidably engageable with said guide surface.

10. The combination according to claim 9, said housing having two external and two internal slots, the external slots being on opposite sides of the apex, the internal slots being formed on flat surfaces of the housing.

11. The combination according to claim 1, further provided with means guiding said rod in a manner permitting unrestrained movement of the rod about its axis, said cam having an annular inclined surface whereby said cam follower mounted within said housing will be actuated regardless of the rotated position of the rod and cam.

12. The combination according to claim 11, said connection between the outer portion of said rod and said reciprocable member comprising a yoke having spaced arms connected to said reciprocable member and a third arm connected to said rod.

13. The combination according to claim 12, the connection between said yoke arms and reciprocable member comprising a pair of spaced discs secured to said reciprocable member, and a washer between said discs, said yoke arms being disposed between the discs with radial clearance between the yoke arms and washer.

14. The combination according to claim 11, said connection between the cam actuating rod and reciprocable member comprising an insulative bushing surrounding said rod, a connector having a pair of ears extending on opposite sides of the bushing, means for drawing together the ends of said ears around said bushing, a portion of said connector extending from said ears in a radial plane with respect to said rod, and a member connected at one end to said last-mentioned portion of the connector and at the other end to said reciprocable member.

15. The combination according to claim 14, said last-mentioned member comprising a yoke having a slotted portion connected to said radial portion of the connector, whereby the position of the yoke with respect to the connector may be preselected, and a pair of arms on said yoke extending on opposite sides of said reciprocable member, the reciprocable member having a pair of discs disposed on opposite sides of said yoke arms.

16. The combination according to claim 1, one of said end plates carrying a bearing for slidably and rockably supporting said rod, a scraper carried by said bearing and engageable with the rod to prevent contaminants from entering the housing, and a dust shield boot surrounding the outer portion of said rod and secured at one end to said bearing and at the other end to said rod.

17. The combination according to claim 1, said housing comprising a portion of an extruded member, said reciprocable member comprising a piston rod for a fluid-actuated motor having a pair of cylinder ports, said stationary support comprising the cylinder of said motor, a pair of fittings extending from said portion having cylindrical surfaces, said clamp means comprising straps surrounding said cylindrical surfaces, there being two external and two internal slots formed as part of said housing extruded member, said external slots being on opposite sides of said housing apex, whereby the clamp means are alternately mountable in said external slots, said internal slots being formed on oppositely facing flat surfaces of the housing interior, means guiding said cam actuating rod in a manner permitting unrestrained movement about its axis, said cam having an annular cam actuating surface whereby limit switches may be actuated regardless of the rotational position of the rod, said connection between the rod and reciprocable member comprising a yoke having arms on opposite sides of the piston rod, a connector having a portion secured to said yoke and a pair of ears surrounding said cam actuating rod, a split bushing between said ears and cam actuating rod, and means for clamping said ears to said bushing and cam actuating rod.

18. In a limit switch actuator, a limit switch housing, means for mounting limit switches within said housing, means on the exterior of said housing for securing it directly to the cylinder of a reciprocable motor having a piston rod, a cam actuating rod slidable within the interior of the housing, a cam on said cam actuating rod engageable with said limit switches, and connecting means between said piston rod and the outer end of said cam actuating rod comprising a pair of plates on said piston rod, a yoke having arms disposed between said plates, a connector having a portion secured to the other end of said yoke, and portions on said connector which clamp the connector onto said cam actuating rod.

19. The combination according to claim 18, further provided with a washer between the plates, there being radial clearance between said yoke arms and washer.

20. The combination according to claim 18, further provided with means guiding said cam actuating rod in a manner permitting unrestrained movement of the rod about its axis, said cam having an annular limit switch actuating surface, whereby misalignment between said piston rod and cam actuating rod will not affect the accuracy of switch actuation.

21. The combination according to claim 18, further provided with a split bushing fabricated of electrically insulative material between said connector portions and said cam actuating rod.

22. In a limit switch actuator, a limit switch support, means for mounting a limit switch on said support, a cam actuating rod slidably mounted on said support, a cam on said rod, means guiding said cam actuating rod and cam in a manner permitting unrestrained movement of the cam and rod about their common axis, the cam having an annular limit switch actuating surface whereby a limit switch may be actuated accurately regardless of the rotational position of the cam and rod, a reciprocable member for moving said rod, a connection between said reciprocable member and said rod, said connection comprising a first portion held to said reciprocable member in a manner preventing relative axial movement therebetween but permitting free relative rotary movement, and a second portion fixed to said rod so as to prevent either axial or rotary movement therebetween.

23. The combination according to claim 22, further provided with means on said limit switch support for alternately mounting said support in any of various positions on a stationary support, said positions being angularly spaced around said rod axis, said first portion of the connection between the rod and said reciprocable member permitting said alternate mounting.

24. The combination according to claim 22, said first portion of the connection having slight radial play with respect to said reciprocable member, and means for adjusting the distance between the first and second portions of said connection.

* * * * *